United States Patent [19]

Kent

[11] 3,964,758

[45] June 22, 1976

[54] SKI BINDING

[76] Inventor: James A. Kent, 3424 62nd Ave. SW., Seattle, Wash. 98116

[22] Filed: Aug. 21, 1974

[21] Appl. No.: 499,540

[52] U.S. Cl. ..... 280/613; 280/618; 280/636

[51] Int. Cl.[2] ..... A63C 9/086

[58] Field of Search ..... 280/11.35 D, 11.35 R, 280/11.35 M, 11.35 Y, 11.35 R; 36/2.5

[56] References Cited

UNITED STATES PATENTS

| | | | |
|---|---|---|---|
| 2,470,840 | 5/1949 | Anz | 280/11.3 |
| 2,717,784 | 9/1955 | Glenn | 280/11.3 |
| 3,672,695 | 6/1972 | Baukhage | 280/11.35 K |
| 3,764,154 | 10/1973 | Witting | 280/11.35 K |
| 3,771,806 | 11/1973 | Hinterholzer et al. | 280/11.35 D |
| 3,772,802 | 11/1973 | Smolka et al. | 280/11.35 D |
| 3,785,668 | 1/1974 | Marker | 280/11.35 R |
| 3,810,643 | 5/1974 | Druss | 280/11.35 R |
| 3,852,896 | 12/1974 | Pyzel et al. | 36/2.5 AL |

FOREIGN PATENTS OR APPLICATIONS

| | | | |
|---|---|---|---|
| 651,993 | 11/1962 | Canada | 280/11.35 |
| 1,365,178 | 5/1964 | France | 280/11.35 |

*Primary Examiner*—M. H. Wood, Jr.
*Assistant Examiner*—David M. Mitchell
*Attorney, Agent, or Firm*—Morton, Bernard, Brown, Roberts & Sutherland

[57] ABSTRACT

A ski binding permitting rapid and easy attachment of skis to ski boots while also permitting sure, reliable disengagement of the skis from the ski boots upon application of a pre-set amount of twisting force, thereby minimizing the risk of injury to the skier in the event the skier falls. A first assembly is attached to each ski and includes a housing having a cam positioned therein and rotatable between a hook-retaining position and a hook-releasing position, a first bias device for inhibiting rotation of the cam from the hook-retaining position to the hook releasing position, and a second bias device for retaining a hook within the cam. A second assembly is provided to attach to the skier's boots, and the first and second assemblies are releasably coupled together by a hook. In one embodiment, the second assembly includes a housing attached to the ski boot and having a slot for receipt of the hook, a movable pin to retain the hook in the housing, and a lever for controlling movement of the pin. In a second embodiment, the second assembly includes a plate having the hook attached thereto and means for fastening the plate to the ski boot.

21 Claims, 24 Drawing Figures

FIG. 1
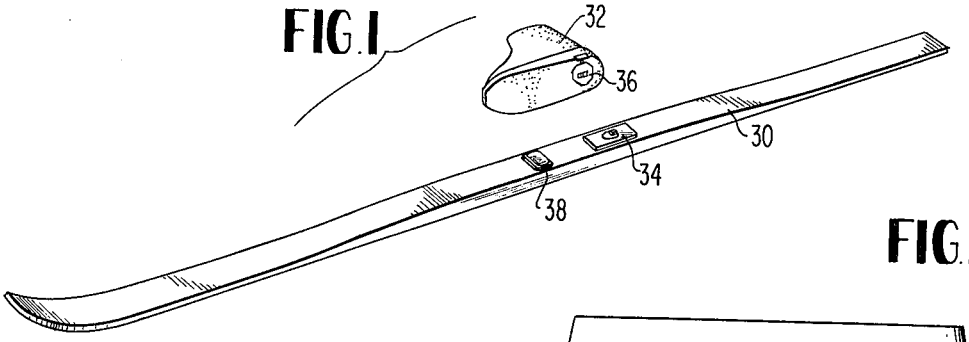
FIG. 2
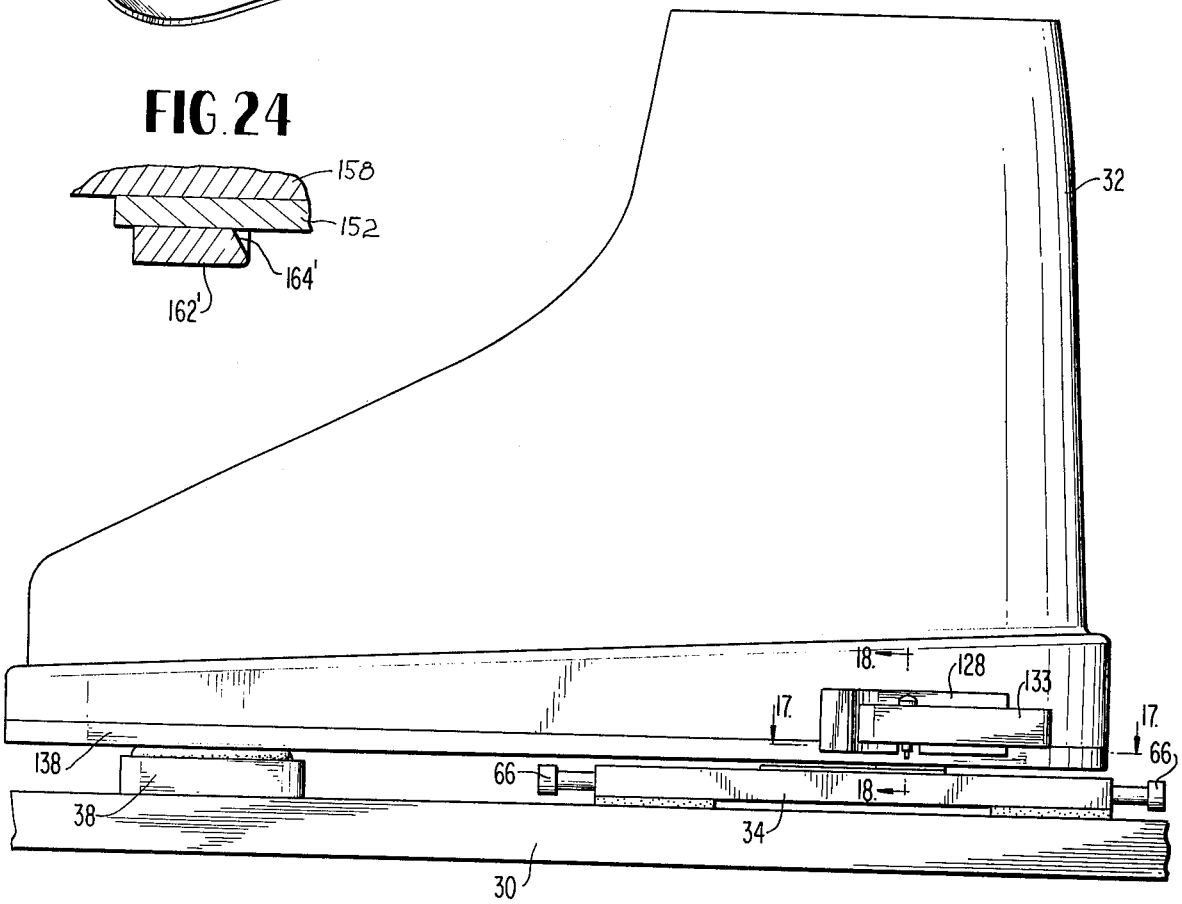
FIG. 24
FIG. 3
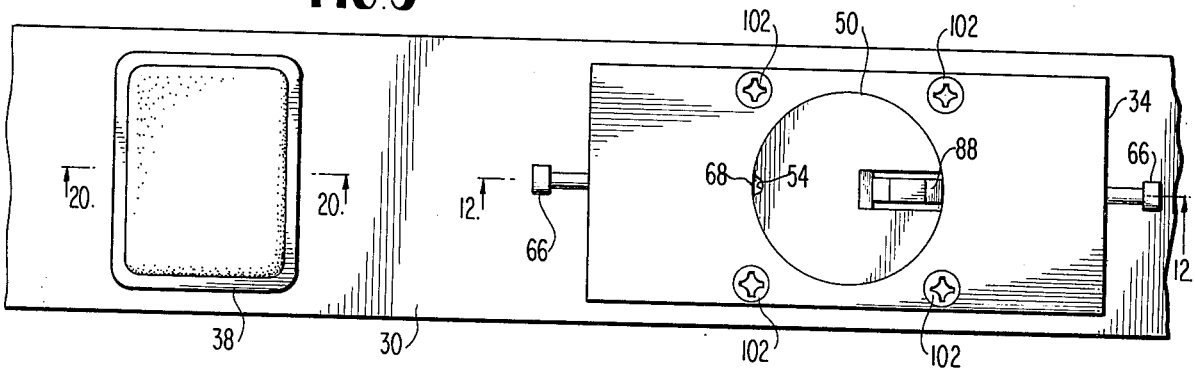

FIG. 4
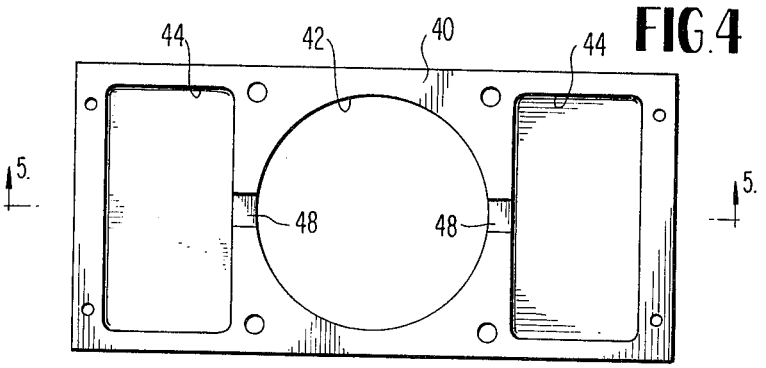
FIG. 6
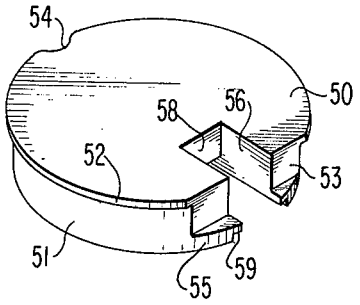
FIG. 5
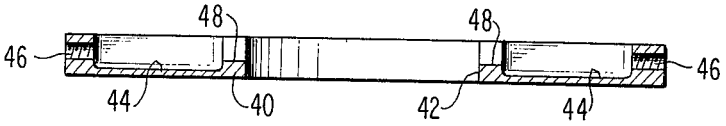
FIG. 7
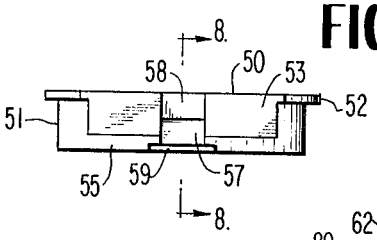
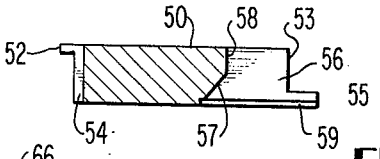
FIG. 8
FIG. 9
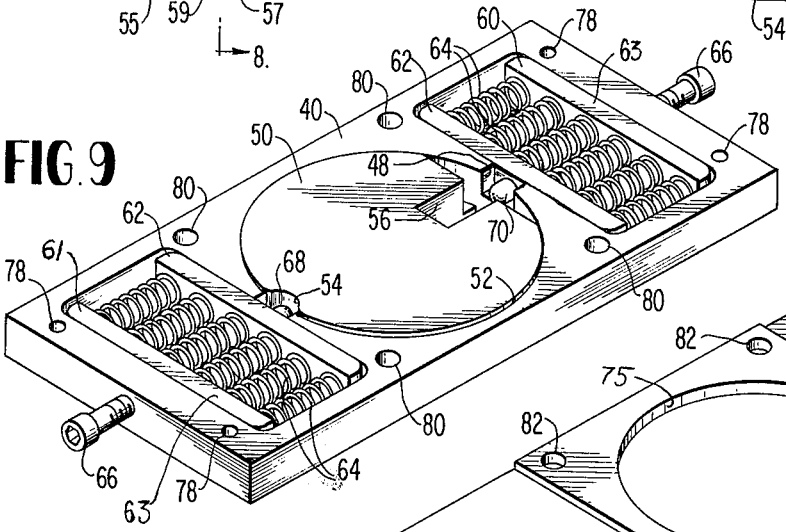
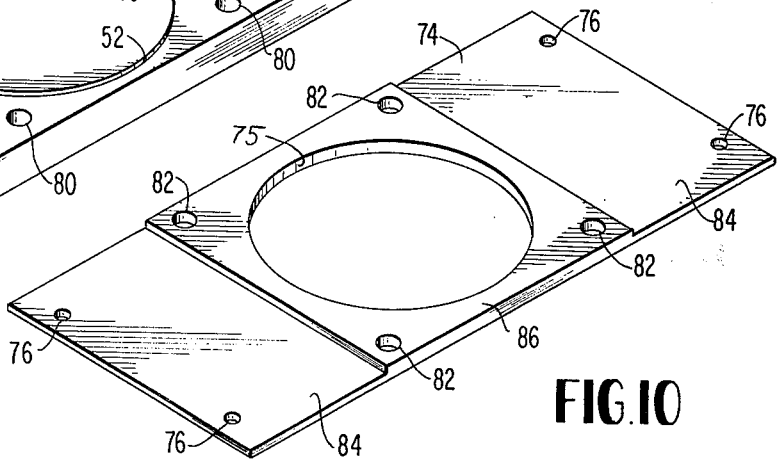
FIG. 10
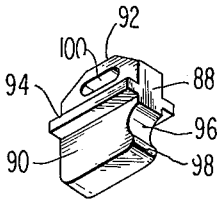
FIG. 11

FIG. 12
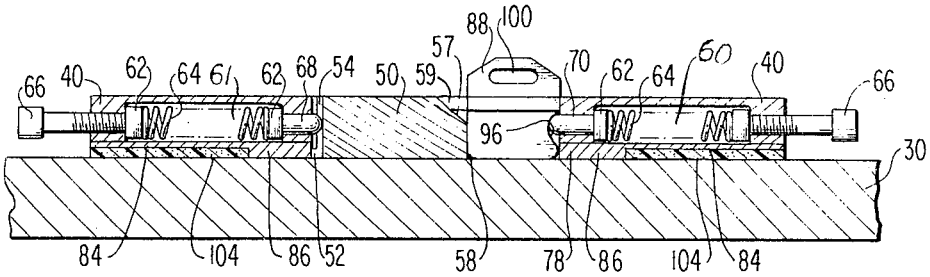
FIG. 13
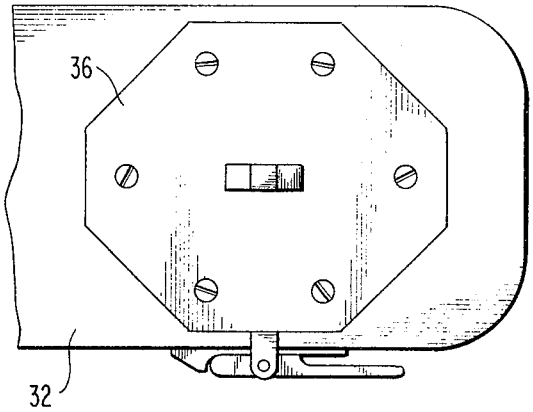
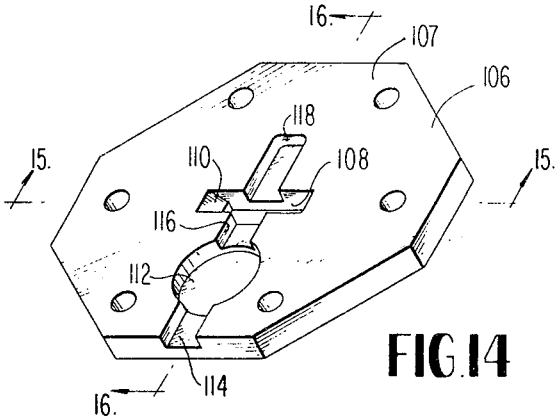
FIG. 14
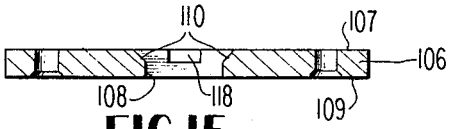
FIG. 15
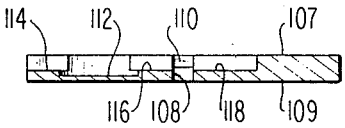
FIG. 16
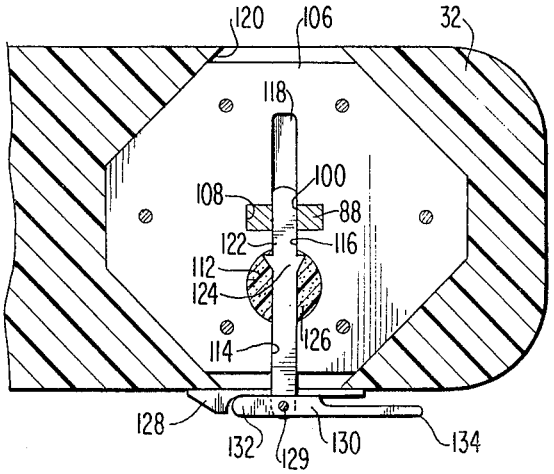
FIG. 17
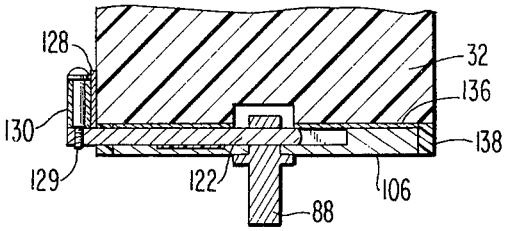
FIG. 18

FIG. 22
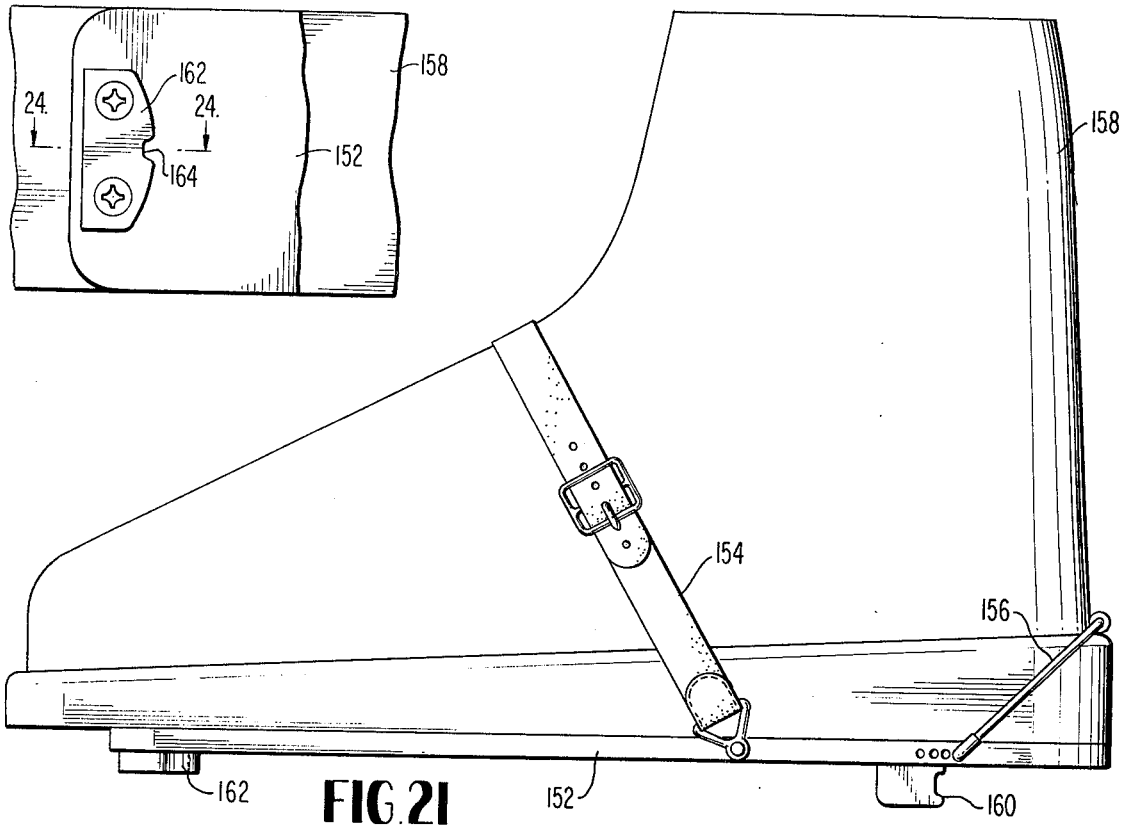
FIG. 21
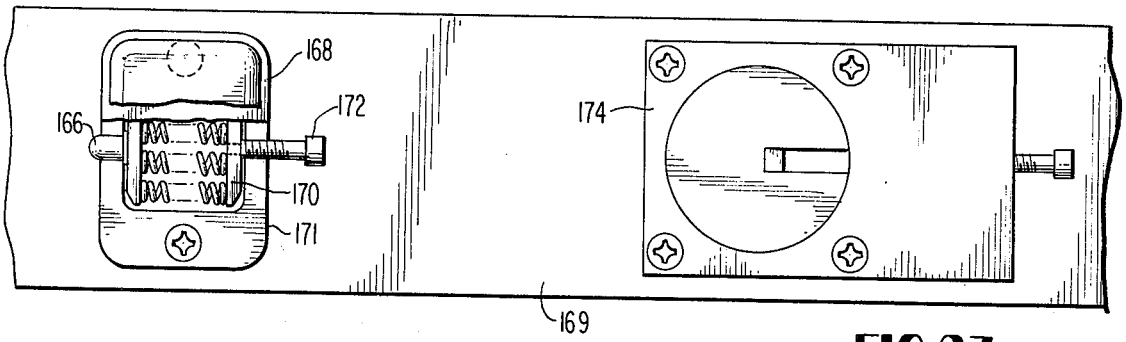
FIG. 23
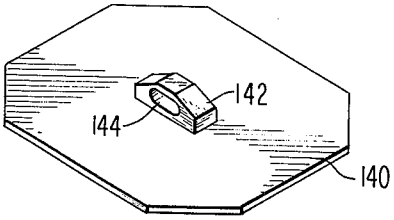
FIG. 19
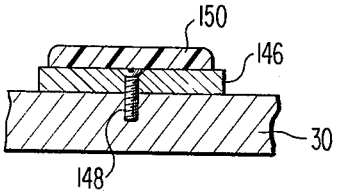
FIG. 20

SKI BINDING

The present invention pertains to a ski binding. More particularly, the present invention pertains to a system for attaching a ski to a ski boot in a releasable manner, permitting regulation of the amount of twisting or bending force required to cause removal of the ski boot from the ski.

When skiing, the skis must be held firmly to the boots of the skier so that he can control his travel. On the other hand, to lessen the liklihood of injury to the skier, the ski binding should reliably release the ski from the ski boot when a given amount of twisting or bending force exists between the ski and the ski boot, for example in the event the skier falls. A large number of ski bindings are available for holding skis to the boots of a skier. The simplest of these consists of straps to fasten the skis to the boots. These straps are cumbersome to attach, and, in addition, they do not readily release the ski from the boot in the event the skier falls. Most desirably, the ski binding should be one which permits the skier to simply step onto the skis with a minimum of manual fastening required. A number of complex ski bindings have been developed in attempts to achieve these ends. Such ski bindings are described, for example, in a series of articles entitled "Know Your Binding" appearing in various issues of SKIING magazine. See for example the issues of SKIING dated February, 1969 and January, 1974. Other ski bindings are shown, for example, in U.S. Pat. Nos. 3,608,919 and 3,689,096 and in Canadian Patent No. 651,993 and French Patent No. 1,365,178. While the ski bindings shown in these various patents and publications provide better operation than simple straps, still room for improvement exists. The article "Ski Bindings Should be Redesigned" appearing at page 28 of the Feb. 4, 1974 issue of *Design News* discusses the need for such improvement. The many devices presently known generally require bulky and cumbersome apparatus to fit around the boot of the skier. This is awkward to utilize and difficult to assemble.

The present invention is a ski binding permitting rapid and easy attachment of skis to ski boots in a manner which provides a sturdy, reliable attachment, and yet which permits sure, ready disengagement of the skis from the ski boots upon application of a pre-set amount of twisting or bending force, thereby minimizing the risk of injury to the skier. In accordance with the present invention, a first assembly is attached to a ski while a second assembly is attached to the bottom of the skier's boot. During skiing the two assemblies are linked together by a hook. A separate set of assemblies is, of course, provided for each of the skier's two skis and two ski boots. In one embodiment of the present invention, when the skis are not in use, the hook is normally releasably positioned in the ski assembly, extending upwardly therefrom. When a person desires to ski utilizing a ski binding in accordance with that embodiment of the present invention, he steps onto the skis so that the hook of each ski goes into a slot in the boot assembly on the corresponding boot. A lever is then moved, causing a latching pin to releasably secure the hook to the boot assembly. In another embodiment of the present invention, the hool is fixedly connected to the lower surface of a plate and is releasably positioned in the ski assembly. When skiing is desired, the skier steps onto the upper surface of the plate and fastens the plate, and thus the ski, to his boot.

Should the skier fall, the resulting twisting or bending forces cause the hook to pull out of the ski assembly, releasing the ski and thereby minimizing the risk of injury to the skier. When the skier wants to remove his skis, he moves the lever of the first embodiment of the present invention, to release the hook from the boot assembly, and he steps off the ski, leaving the hook with the ski assembly. With the second embodiment of the invention, the skier removes the plates from his boots when he has finished skiing.

The ski assembly includes a housing having a cam within it which engages the hook. The ski assembly also includes springs which bias a pin that engages the cam so that at least a minimum amount of twisting force is required before the cam is permitted to rotate. When the ski is lying on level ground, the plane of rotation of the cam is a horizontal plane. The amount of force applied by the springs can be regulated to permit the skier to control the amount of twisting force required to rotate the cam and the hook in that plane. When the cam and hook rotate, the hook is released from the ski assembly, and so the ski is separated from the ski boot. The hook fits into a slot within the cam and is held therein by a second pin. A second set of springs biases the second pin to require at least a minimum amount of twisting force before the pin is permitted to rotate in a vertical plane through the longitudinal axis of the ski. The amount of force applied by the second set of springs can likewise be regulated to permit the skier to control the amount of twisting force required to rotate the hook in the vertical plane. When the hook rotates in the vertical plane, it is released from the ski assembly and again the ski is separated from the skier's boot.

In one embodiment of the present invention, the boot assembly includes a housing having a rectangular slot for receipt of the hook. A latching pin within the boot assembly is controlled by a lever so that the pin can be inserted into and retracted from an opening with the hook, thus permitting rapid attachment and release of the ski to the ski boot when the skier wishes to put on or take off his skis.

In a further embodiment of the present invention, the boot assembly includes a plate for attachment to the boot of the skier, and the hook is affixed to the plate, thus permitting use of the ski binding of the present invention with any ski boots. As an additional variation, if desired, the ski assembly can be separated into two housings, one for retaining the hook and including bias means for resisting twisting forces in the vertical plane, and a second including bias means for resisting twisting forces in the horizontal plane. Of course, as the skis move from their position lying on level ground, the two planes of rotation are no longer horizontal and vertical, but for clarity the ski binding of the present invention is described with reference to a ski lying on a level surface with these planes described as "horizontal" and "vertical", it being understood that the cam and hook operate to release the ski from the skier's boot upon application of appropriate forces regardless of the orientation of the ski. A force in any direction can, of course, be broken down into "horizontal" and "vertical" components which act on the cam and the hook.

These and other aspects and advantages of the present invention are more apparent in the following detailed description and claims, particularly when considered in conjunction with the accompanying drawings in which like parts bear like reference numerals. In the drawings:

FIG. 1 is a perspective view of a ski and a ski boot including a ski binding in accordance with the present invention;

FIG. 2 is a side elevational view of a ski boot attached to a ski utilizing a ski binding in accordance with the present invention;

FIG. 3 is a fragmentary plan view of a ski including a ski assembly suitable for inclusion in a ski binding in accordance with the present invention;

FIG. 4 is a plan view of a housing suitable for incorporation into the ski assembly of FIG. 3 in accordance with the present invention;

FIG. 5 is a sectional view taken along 5—5 of FIG. 4;

FIG. 6 is a perspective view of a cam assembly suitable for incorporation into a ski binding in accordance with the present invention;

FIG. 7 is an elevational view of the cam assembly of FIG. 6;

FIG. 8 is a sectional view taken along line 8—8 of FIG. 7;

FIG. 9 is a perspective view of a portion of a ski assembly suitable for incorporation into a ski binding in accordance with the present invention;

FIG. 10 is a perspective view of a cover suitable for use with the ski assembly of FIG. 9;

FIG. 11 is a perspective view of a hook assembly suitably for incorporation into a ski binding in accordance with the present invention;

FIG. 12 is a sectional view taken along line 12—12 of FIG. 3;

FIG. 13 is a fragmentary plan view of a ski boot including a boot assembly suitable for inclusion in a ski binding in accordance with the present invention;

FIG. 14 is a perspective view of a housing suitable for incorporation into the boot assembly of FIG. 13 in accordance with the present invention;

FIG. 15 is a sectional view taken along line 15—15 of FIG. 14;

FIG. 16 is a sectional view taken along line 16—16 of FIG. 14;

FIG. 17 is a sectional view taken along line 17—17 of FIG. 2;

FIG. 18 is a sectional view taken along line 18—18 of FIG. 2;

FIG. 19 is a perspective view of a cover plate suitable for use in conjunction with the boot assembly of FIGS. 13–18 in accordance with the present invention;

FIG. 20 is a sectional view taken along line 20—20 of FIG. 3 and illustrating a toe pad suitable for use with a ski binding in accordance with the present invention;

FIG. 21 is a side elevational view of a ski boot depicting a modified embodiment of the ski binding in accordance with the present invention;

FIG. 22 is a fragmentary plan view of a ski boot including a toe camming plate suitable for use in a ski binding in accordance with the present invention;

FIG. 23 is a plan view of a ski including modified embodiments of a ski assembly suitable for incorporation into a ski binding in accordance with the present invention; and FIG. 24 is a fragmentary sectional view along line 24—24 of FIG. 22.

FIG. 1 illustrates ski 30 and ski boot 32 having a ski binding in accordance with the present invention. Ski assembly 34 is attached to the upper surface of ski 30, while boot assembly 36 is attached to the lower surface of boot 32 in a position to mate with ski assembly 34 when a skier wearing boot 32 stands upon the ski 30 in the normal skiing position. A toe pad 38 is also attached to the surface of ski 30 to support the toe of boot 32 during skiing. FIG. 2 illustrates the manner in which the ski boot 32 rests upon ski 30 during skiing. The toe of ski boot 32 is supported by pad 38, while the heel of boot 32 is supported by ski assembly 34.

FIG. 3 is a fragmentary plan view showing ski 30 with ski assembly 34 and toe pad 38 attached thereto. Ski assembly 34 includes a housing 40 illustrated in FIGS. 4 and 5. The housing 40, for example, can be a substantially rectangular block having a circular opening 42 passing therethrough. By way of illustration housing 40 might have a length in the order of 5.6 inches a width in the order of 2.5 inches and a thickness in the order of 0.33 inches, while opening 42 might have a diameter in the order of 2.00 inches, being substantially centered on housing 40. A substantially rectangular recess 44 is provided on each side of opening 42 in one face of the housing 40. By way of example, each recess 44 might extend about 2.2 inches across the width of housing 40, and might have a width, parallel with the length of housing 40, in the order of 1.3 inches. Each recess 44 might extend into housing 40 a depth in the order of 0.28 inches. A threaded opening 46 is provided through each end of housing 40 into each recess 44. In the face of housing 40 to which recesses 44 open, channels 48 are provided, communicating each recess 44 with central opening 42. Each channel 48 might have both a width and a depth in the order of 0.25 inches.

FIGS. 6, 7 and 8 depict a circular cam member 50 which fits within opening 42 of housing 40. Cam member 50 includes a main body portion 51 in the form of an essentially circular disc having a diameter in the order of 1.99 inches to permit main body portion 51 to fit snugly but rotatably within opening 42. One surface of cam 50 includes a lip 52 with a diameter slightly greater than the diameter of opening 42, for example a diameter in the order of 2.1 inches. Cam member 50 might have an overall thickness in the order of 0.45 inch, while lip 52 might have a thickness in the order of 0.1 inch. A face 53 is formed along a chord of cam member 50, with face 53 passing through lip 52 and through a major amount of the thickness of body portion 51, leaving a ledge portion 55, with a thickness in the order of 0.1 inch, on the surface opposite lip 52. Face 53 might be about 0.75 inch from the center of circular body portion 51.

A radial slot 56 is formed in cam 50, intersecting the center of face 52. Slot 56 might extend into main body portion 51 a radial distance in the order of 0.75 inch and migth have a width in the order of 0.25 inch. As seen in FIG. 8, the back surface 58 of slot 56 extends from the first flat surface of disc-shaped cam member 50 substantially perpendicular to that first flat surface for approximately one-half the thickness of cam member 50 and then angles away from face 53 to form angled surface 57 which intersects the second flat surface of cam member 50 at a point about 0.95 inch from the circumferential edge of ledge portion 55. This second flat surface of cam member 50 is chamfered over an area 59 on each side of slot 56 for a width in teh order of 0.17 inch and to a depth in the order of 0.03 inch.

A radial groove 54 is formed in the edge of cam 50, passing through the entire thickness of the cam, including lip 52, radially opposite slot 56. Groove 54 might have a radial depth in the order of 0.1 inch and a minimum width in the order of 0.14 inch, with angled sides, the extension of each of which intersects at an angle in the order of 30° with the diameter of cam 50 that passes through the centers of groove 54 and slot 56.

As shown in FIG. 9, cam member 50 fits within opening 42 of housing assembly 40 with lip 52 resting on one surface of housing assembly 40. A spring assembly 61 is positioned within one recess 44 of housing assembly 40, while a spring assembly 60 is positioned within the other recess 44. Each spring assembly 60 and 61 includes a first bar member 62 and a second bar member 63 with a plurality of springs 64 between the first and second bar members 62 and 63 to urge the bar members apart. A bolt 66 is threaded into each opening 46 to act against the adjacent bar member 63 to control the tension of the corresponding spring assembly 60 or 61. From the bar member 62 adjacent groove 54 a pin member 68 extends through channel 48 into groove 54. From the bar member 62 adjacent slot 56 a similar pin member 70 extends through channel 48 into slot 56.

FIG. 10 depicts a cover 74 for housing 40. Cover 74 has a central opening 75 of a diameter slightly greater than the diameter of lip 52 on cam member 50, for example a diameter in the order of 2.15 inches. Openings 76 are provided adjacent each corner for passage of bolts therethrough. Housing 40 includes threaded openings 78 adjacent each corner and corresponding with openings 76 for receipt of bolts to permit fastening of cover 74 onto housing 40. Housing 40 includes openings 80 passing therethrough adjacent each quadrant of opening 42. Cover 74 has mating openings 82 so that when cover 74 is fastened to housing 40, openings 80 and 82 permit passage of screws or other fastening means to fasten the resulting ski assembly 34 onto a ski 30. Cover 74 is of a length and width substantially identical with the length and width of housing 40. Cover 74 includes end portions 84 having a thickness in the order of 0.04 inch and a central portion 86 having a thickness in the order of 0.11 inch. Portion 86 might extend about 3.0 inches over the length of cover 74.

FIG. 11 illustrates a hook member 88 suitable for incorporation into the ski binding of the present invention. Hook member 88 includes a hooking portion 90 and a head portion 92 separated by flange portion 94. Hooking portion 90 might be substantially rectangular having a length in the order of 0.75 inch, a height in the order of 0.4 inch, and a thickness in the order of 0.24 inch. A recess 96 is formed in one end face of hooking portion 90 to provide a hook tip 98. Each flange 94 extends outwardly from portions 90 and 92 a distance in the order of 0.12 inch and has a thickness in the order of 0.07 inch. Head portion 92 might have a length in the order of 0.75 inch, a height in the order of 0.32 inch, and a thickness in the order of 0.24 inch. An opening 100 passes through head portion 92.

As seen in FIG. 12 hook 88 fits within slot 56 of cam member 50 when the cam member 50 is positioned in body member 40. Flanges 94 are positioned within chamfered area 59. Cover 74 of FIG. 10 is placed upon body 50 of FIG. 9 and fastened thereto. The resulting ski assembly 34 is fastened to ski 30, with cover 74 adjacent ski 30, as shown in FIG. 12. By way of example, screws 102 can pass through openings 80 and 82 to fasten ski assembly 34 to ski 30, as shown in FIG. 3. The thinner end portions 84 of cover 74 permit ski 30 to flex without flexing housing 40. Resilient pad members 104 of, for example, a sponge silicone rubber are positioned between ski 30 and end portions 84 of cover 74 to prevent accumulation of snow, ice, mud, etc.

Spring assembly 61 biases pin 68 toward cam member 50, and spring assembly 60 biases pin 70 toward hook 88. In the hook-retaining position of cam member 50, depicted in FIG. 12, pin 68 enters groove 54 of cam member 50, while pin 70 enters recess 96 of hook 88. The biase of spring assembly 61 thus acts through pin 68 to restrain cam member 50 from rotation in a horizontal plane from the hook-retaining position of FIGS. 3 and 12 to a hook-releasing position. A twisting force on hook 88 in a horizontal plane acts against the bias of assembly 61 until that bias is overcome and cam member 50 rotates from the hook-retaining position to a hook-releasing position in which hook 88 can withdraw from ski assembly 34. Likewise the bias of spring assembly 60 acts through pin 70 to retain hook 88 within slot 56. A twisting force on hook 88 in a vertical plane acts against the bias of spring assembly 60 until that bias is overcome, permitting hook 88, and the ski boot 32 to which it is attached, to rotate until hook tip 98 is no longer restrained by pin 70, and hook 88 can be withdrawn from ski assembly 34.

FIG. 13 illustrates a boot assembly 36 within the lower surface of boot 32. Boot assembly 36 includes housing 106 shown in FIGS. 14, 15 and 16. Body portion 106 is depicted as an eight-sided plate with a first surface 107 and a second surface 109 and having a thickness in the order of 0.21 inch; however housing 106 need not be an octagon, since all eight sides need not be of the same length. A rectangular opening or slot 108 passes through housing 106 at substantially the center thereof. Adjacent first surface 107, each end of opening 108 is chamfered at an angle in the order of 45° for approximately half the thickness of plate 106 to provide chamfered surfaces 110. Adjacent surface 109, opening 108 might have a length in the order of 0.75 inch and a width in the order of 0.25 inch. A substantially circular recess 112 is provided in surface 107 intermediate one side of slot 108 and one outer edge of plate 106. Recess 112 might extend into plate 106 a depth in the order of 0.15 inch. Channel 114 in surface 107 communicates recess 112 with the peripheral edge of plate 106, while channel 116, also in surface 107 and aligned with channel 114, communicates recess 112 with slot 108. Channel 118 is a continuation of channels 114 and 116 on the opposite side of slot 108 and might extend a distance in the order of 0.4 inch beyond slot 108. Channels 114, 116, and 118 might extend into plate 106 a depth in the order of 0.13 inch.

FIGS. 17 and 18 depict boot assembly 36 within boot 32. Plate 106 is fitted within a mating recess 120 in the lower surface of boot 32. Upper portion 92 of hook member 88 fits within slot 108. A pin passes through channel 114, recess 112, channel 116, opening 100 of pin 88, and channel 118. Pin 122 preferably includes an enlarged portion 124 within recess 112 to limit travel of pin 122. Preferably, pin 122 is formed in two parts threadedly fitted together at enlarged portion 124 to permit adjustment to accommodate different width ski boots. Preferably also, a resilient material 127 such as a silicon sponge rubber surrounds pin 122 within recess 112 to cooperate with enlarged portion 124 to bias pin 122 into slot 108. Plate member 128 is fastened to the exterior surface of boot 32 adjacent plate 106. Outside boot 32 and beyond plate member 128, pin 129 rotatably fastens pin 122 to lever 130. Lever 130 includes a camming portion 132, which contacts plate 128, and a thinner, handle portion 134, which does not contact plate 128. As handle portion 134 is moved away from boot 32 to rotate lever 130, camming portion 132 acts against plate 128, with the result that pin 122 is pulled outward from housing 106 until enlarged portion 124 limits the further extraction of pin 122. Preferably, as illustrated in FIG. 18, a cover 136, of substantially the same peripheral shape as body 106, is provided between body 106 and boot 32.

Boot assembly 36 can be positioned within a recess provided in the lower surface of the conventional heel area of ski boot 32. Alternatively, to enable attachment of boot assembly 36 to any ski boat, a cover 138, having a recess 120 within it to receive boot assembly 36, can be provided for permanent attachment to the lower surface of any ski boot, for example, by bolts, screws, nails, adhesive or otherwise. FIG. 19 depicts a cover assembly 140 which can be utilized to protect boot assembly 36 when not skiing. Cover assembly 140 includes an attachment member 142 having an opening 144 for engagement by pin 122 to retain cover assembly 140 beneath the heel portion of boot 32.

Toe pad 38 can be any suitable pad, and for example, can be formed, as depicted in FIG. 20, of a metal plate 146 fastened by bolts 148 to ski 30, with a suitable skid resistant surface 150, such as a Teflon surface, bonded to plate 146.

To ski utilizing the ski binder of the FIGS. 1–19, the skier puts on ski boots 32 and moves lever 130 to retract pin 122 from slot 108. Hook 88 extends upward from ski assembly 34. The skier then steps onto the skis as illustrated in FIG. 2, so that boot assembly 36 is adjacent ski assembly 34, causing upper body portion 92 of hook 88 to enter slot 108. Lever 130 is then returned to the position illustrated in FIG. 17, causing pin 122 to pass through opening 100 of hook 88. This firmly connects the skis to the bottom of the ski boots. Hook 88 fits within slot 108 snugly so that, with pin 122 passing through opening 100, hook 88 cannot rotate within boot assembly 36. Pins 68 and 70 act on groove 54 and recess 96 to inhibit rotation of ski 30. Ski 30 is thus securely connected to ski boot 32 for normal skiing.

Should the skier fall, with a resulting sideways twisting of the ski 30 in a plane parallel to the plane of rotation of cam member 50, cam member 50 tends to twist within opening 42 of plate 40, while hook 88 is prevented from twisting within slot 108. If sufficient twisting force is applied, the bias of spring assembly 61 is overcome, forcing pin 68 outwardly from opening 42. As a consequence, hook 88 rotates so that it is no longer restrained by pin 70. Hook 88 then pulls outward from ski assembly 34, freeing ski 30 from ski boot 32. The amount of sideways twisting required to rotate hook 88 is regulated by adjusting bolt 66 of spring assembly 61. If a skier falls and the forward end of ski 30 is forced upward, a twisting force in a plane parallel to the longitudinal axis of ski 30 is applied. When the twisting force is sufficient to overcome the bias of spring assembly 60, tip 98 of hook 88 forces pin member 70 outwardly from opening 42. Hook 88 then rotates to pull out from ski assembly 34, thus freeing ski 30 from ski boot 32. The amount of upward twisting force required to free hook 88 is regulated by adjusting bolt 66 of spring assembly 60. Positioned within ski assembly 34, hook 88 thus acts as a shear pin to support the high load exerted by ski 30 upon ski boot 32 during normal skiing while assuring that should that load exceed the pre-set, maximum determined by the adjustment of bolts 66, ski assembly 34 disengages from ski boot 32.

FIG. 21 depicts a modified embodiment of a ski binding in accordance with the present invention. Plate 152 is attached to a conventional ski boot 158 by means such as straps 154 and 156 or any other conventional connection devices, for example cables, rods, etc. Hook 160 extends from the lower surface of plate 152 to mate with ski assembly 34. When the skier is not going to be skiing and wishes to walk, he simply releases strap 154 to remove plate 152 from ski boot 158.

A further variation of the present invention, depicted in FIGS. 21, 22, 23, and 24, separates the control of the horizontal twisting force and the vertical twisting force. A toe camming plate 162 is positioned beneath the toe of the ski boot. Camming plate 162 can, of course, be utilized either with plate 152 of FIG. 21 or with ski boot 32 of FIG. 2. As seen in FIG. 22, toe camming plate 162 is provided with a groove 164 to mate with pin 166 of ski toe assembly 168 which is mounted on ski 169, as shown in FIG. 23. FIG. 24 depicts a variation in which camming plate 162' has an angled groove 164', the upper end of which extends further into camming plate 162' than does the lower end. Angled groove 164' provides the skier with increased control. Spring assembly 170, which is similar to spring assemblies 60 and 61 of FIG. 9, is positioned within housing 171 of toe assembly 168. Adjustment bolt 172 controls the bias of spring assembly 170 to control the amount of twisting force required before pin 166 is released from groove 164. As a consequence, ski heel assembly 174 includes only the one spring assembly 60, and so release of ski 169 from the ski boot as a result of a twisting force in a horizontal plane is controlled by ski toe assembly 168, while release of ski 169 from the ski boot as a result of a twisting force in a vertical plane is controlled by ski heel assembly 174. Toe camming plate 162 could, of course, be utilized with spring assemblies 170 and 60 in a single housing similar to housing 40 of FIG. 9.

It is thus seen that a ski binding in accordance with the present invention provides secure fastening of the skis to the ski boots during ordinary skiing while assuring reliable release of the skis in the event the skier should fall and twist the skis relative to the skiers legs, thereby minimizing the possibility of injury to the skier. Although the present invention has been described with reference to preferred embodiments, numerous modifications and rearrangements could be made, and still the result would come within the scope of the invention.

What is claimed is:

1. A ski binding comprising:

a. a ski assembly adapted for attachment to a ski and including:

i. housing means having an opening therein;

ii. a cam member positioned within the opening of said ski assembly housing means and having a slot therein adapted to receive a hook, said cam member rotatable within the opening of said ski assembly housing means between a hook-retaining position and a hook-releasing position;

iii. first bias means for restraining said cam member from rotating from the hook-retaining position to the hook-releasing position; and iv. second bias means for restraining a hook within the cam member slot from removal therefrom; and b. a boot assembly including:

i. a plate member ii. attachment means for attaching the plate member to a ski boot; and iii. a hook connected to said plate member and adapted for insertion into said cam member slot; said hook normally assuming a retained position in which said hook is retained within the cam member slot by said second bias means and so long as said cam member is in the hook-retaining position; said hook in response to application thereto of a twisting force in a horizontal plane, applying a force to said cam member to act against said first bias means until said first bias means is overcome, permitting said cam member to rotate to the hook-releasing position to release said hook from said ski assembly; said hook, in response to application thereto of a twisting force in a vertical plane applying a force to said second bias means until said second bias means is over-come, releasing said hook from said ski assembly.

2. A ski binding as claimed in claim 1 wherein said cam member has a groove in one surface thereof and wherein said first bias means comprises spring means and a pin member positioned between said spring means and said cam member to be urged toward said cam member by said spring means, said pin member entering said cam member groove when said cam member is in the hook-retaining position.

3. A ski binding as claimed in claim 2 wherein said first bias means further includes adjustment means for controlling the bias of said spring means.

4. A ski binding as claimed in claim 1 in which said hook has a recess in one surface thereof and wherein said second bias means comprises spring means and a pin member positioned between said spring means and said hook to be urged toward said hook by said spring means, said pin member entering said hook recess in the absence of a twisting force in a vertical plane.

5. A ski binding as claimed in claim 4 wherein said second bias means further includes adjustment means for controlling the bias of said spring means.

6. A ski binding as claimed in claim 1 wherein:

said cam member has a groove in one surface thereof;

said hook has a recess in one surface thereof;

said first bias means comprises first spring means and a first pin member positioned between said first spring means and said cam member to be urged toward said cam member by said first spring means, said first pin member entering said cam member groove when said cam member is in the hook-retaining position; and said second bias means comprises second spring means and a second pin member positioned between said second spring means and said hook to be urged toward said hook by said second spring means, said second pin member entering said hook recess in the absence of a twisting force in a vertical plane.

7. A ski binding as claimed in claim 6 wherein said first bias means further includes first adjustment means for controlling the bias of said first spring means and wherein said second bias means further includes second adjustment means for controlling the bias of said second spring means.

8. A ski binding as claimed in claim 1 further comprising a camming plate adapted for attachment to a ski boot and having a groove, and wherein said first bias means comprises spring means and a pin member positioned to be urged by said spring means outwardly from said housing means, whereby with said boot assembly and said camming plate attached to a ski boot and positioned upon said ski assembly and with said ski assembly attached to a ski, said pin member is urged toward said camming plate by said spring means to enter said camming plate groove when said cam member is in the hook-retaining position.

9. A ski binding as claimed in claim 8 in which said camming plate groove is angled to extend further into said camming plate at the surface of said camming plate adapted to be adjacent a ski boot than at the opposite surface of said camming plate.

10. A ski binding as claimed in claim 8 wherein said housing means includes:

a first portion containing said cam member and said second bias means and adapted for attachment to a ski in a position adjacent the heel of a ski boot worn by a skier in a normal skiing position; and a second portion containing said first bias means and adapted for attachment to a ski in a position adjacent the toe of a ski boot worn by the skier in the normal skiing position.

11. A ski binding as claimed in claim 1 wherein said boot assembly attachment means comprises strap means for releasably strapping said plate member to a ski boot.

12. A ski binding as claimed in claim 1 wherein said boot assembly plate member comprises:

a. housing means having a slot therethrough and a channel therein communicating with the boot assembly housing means slot;

b. a pin member within the channel and slidable between a first position in which said pin member extends across the boot assembly housing means slot and a second position in which the pin member is withdrawn from the boot assembly housing means slot; and c. a lever member connected to said pin member for controlling movement of said pin member between the first position and the second position;

and wherein said hook includes a head portion adapted for insertion into the slot of said boot assembly housing, said head portion having an opening for passing thereinto of said pin member when said pin member is in the first position to retain said hook connected to said boot assembly housing means while permitting withdrawal of said hook from said boot assembly housing means when said pin member is in the second position.

13. A ski binding as claimed in claim 12 wherein said boot assembly pin member includes means for preventing withdrawal of said pin member from said boot assembly housing means channel.

14. A ski binding as claimed in claim 13 wherein said boot assembly plate member further comprises bias means for urging said pin member toward the boot assembly housing means slot.

15. A ski binding assembly adapted for attachment to a ski to permit connection of the ski to a ski binding boot assembly, said ski binding ski assembly comprising:

a. housing means having an opening therein;

b. a cam member positioned within the opening of said housing means and having a slot therein adapted to receive a hook from a ski binding boot assembly to couple the ski binding boot assembly with said ski binding ski assembly, said cam member rotatable within the opening of said housing means between a hook-retaining position in which the ski binding boot assembly hook is retained therein and a hook-releasing position in which the ski binding boot assembly hook is released therefrom;

c. first bias means for restraining said cam member from rotating the hook-retaining position to the hook-releasing position; and d. second bias means for restraining removal of the hook from the cam member slot.

16. A ski binding ski assembly as claimed in claim 15 wherein said cam member has a groove in one surface thereof and wherein said first bias means comprises spring means and a pin member positioned between said spring means and said cam member to be urged toward said cam member by said spring means, said pin member entering said cam member groove when said cam member is in the hook-retaining position.

17. A ski binding ski assembly as claimed in claim 16 wherein said first bias means further includes adjustment means for controlling the bias of said spring means.

18. A ski binding boot assembly adapted for attachment to a ski boot to permit connection of the ski boot to a ski binding ski assembly, said ski binding boot assembly comprising:

a. housing means having a slot therethrough adapted to receive a hook from said ski binding ski assembly to couple the ski binding ski assembly with said ski binding boot assembly, said housing means having a channel therein communicating with the housing means slot;

b. a pin member within the channel and slidable between a first position in which said pin member extends across the housing means slot to retain the ski binding ski assembly hook therein and a second position in which the pin member is withdrawn from the housing means slot to release the ski binding ski assembly hook therefrom;

c. a lever member connected to said pin member for controlling movement of said pin member between the first position and the second position; and d. attachment means for attaching the housing means to a ski boot.

19. A ski binding as claimed in claim 18 wherein said boot assembly pin member includes means for preventing withdrawal of said pin member from said boot assembly housing means channel.

20. A ski binding as claimed in claim 19 wherein said boot assembly plate member further comprises bias means for urging said pin member toward the boot assembly housing means slot.

21. A ski binding comprising:

a. a hook member having a first end and a second end;

b. a ski assembly adapted for attachment to a ski and including first retaining means for releasably retaining said hook member first end and operable upon application of a twisting force to release said hook member first end; and c. a boot assembly adapted for attachment to a ski boot and including

1. housing means having a slot therethrough adapted to receive said hook member, said housing means having a channel therein communicating with the housing means slot;

2. a pin member within the channel and slidable between a first position in which said pin member extends across the housing means slot to retain said hook member therein and a second position in which the pin member is withdrawn from the housing means slot to release said hook member therefrom;

3. a lever member connected to said pin member for controlling movement of said pin member between the first position and the second position; and

4. attachment means for attaching the housing means to a ski boot.

* * * * *

UNITED STATES PATENT AND TRADEMARK OFFICE

CERTIFICATE OF CORRECTION

PATENT NO. : 3,964,758

DATED : June 22, 1976

INVENTOR(S) : James A. Kent

It is certified that error appears in the above-identified patent and that said Letters Patent are hereby corrected as shown below:

Column 1, line 66, cancel "hool" and substitute --hook--.

Column 4, line 51, cancel "52" and substitute --53--.

Column 4, line 53, cancel "migth" and substitute --might--.

Column 4, line 63, cancel "teh" and substitute --the--.

Column 5, line 45, cancel "flange" and substitute --flanged--.

Column 6, line 8, cancel "biase" and substitute --bias--.

Column 6, line 61, cancel "127" and substitute --126--.

Column 7, line 58, cancel "the" (second occurrence) and substitute --that--.

Column 10, line 67, after "binding" insert --ski--.

Column 11, line 37, cancel "said" and substitute --a--.

Signed and Sealed this

Twelfth Day of October 1976

[SEAL]

*Attest:*

RUTH C. MASON
*Attesting Officer*

C. MARSHALL DANN
*Commissioner of Patents and Trademarks*